US005100500A

United States Patent [19]

Dastolfo et al.

[11] Patent Number: 5,100,500

[45] Date of Patent: Mar. 31, 1992

[54] MILLING SOLUTION AND METHOD

[75] Inventors: LeRoy E. Dastolfo, Lower Burrell; John E. Mrozinski, Natrona Heights, both of Pa.

[73] Assignee: Aluminum Company of America, Pittsburgh, Pa.

[21] Appl. No.: 652,587

[22] Filed: Feb. 8, 1991

[51] Int. Cl.[5] ..... B44C 1/22; C23F 1/02; C09K 13/08

[52] U.S. Cl. ..... 156/637; 156/654; 156/659.1; 156/664; 252/79.3

[58] Field of Search ..... 156/637, 639, 654, 656, 156/659.1, 664; 252/79.3, 79.4; 134/3, 28, 39, 40, 41

[56] References Cited

U.S. PATENT DOCUMENTS

| | | | |
|---|---|---|---|
| 2,711,364 | 6/1955 | Beach | 41/42 |
| 2,981,610 | 4/1961 | Snyder et al. | 41/42 |
| 3,061,494 | 10/1962 | Snyder et al. | 156/18 |
| 3,078,203 | 2/1963 | LaBoda et al. | 156/18 |
| 3,666,580 | 5/1972 | Kremi et al. | 156/18 |
| 3,788,914 | 1/1974 | Gumbelevicius | 156/18 |
| 3,844,859 | 10/1974 | Roni | 156/18 |
| 3,905,907 | 9/1975 | Shiga | 252/79.4 |
| 3,944,496 | 3/1976 | Coggins et al. | 252/79.3 |
| 3,986,970 | 10/1976 | Shiga | 252/79.3 |
| 4,052,253 | 10/1977 | Kingzett | 252/79.3 X |
| 4,116,755 | 9/1978 | Coggins et al. | 156/659 |
| 4,130,454 | 12/1978 | Dutkewych et al. | 156/659 |
| 4,194,285 | 3/1980 | Goel | 29/579 |
| 4,220,706 | 9/1980 | Spak | 430/318 |
| 4,314,876 | 2/1982 | Kremer et al. | 156/664 |
| 4,704,188 | 11/1987 | Carlson et al. | 156/656 |
| 4,787,958 | 11/1988 | Lytle | 156/652 |
| 4,900,398 | 2/1990 | Chen | 156/664 |

OTHER PUBLICATIONS

"Fundamentals of Chemical Milling", by J. W. Dini, *American Machinist* Special Report 768, Jul. 1984, pp. 113–128.

"Chemical Milling", by J. W. Dini, *International Metallurgical Reviews*, 1975, vol. 20, pp. 29–55.

*Primary Examiner*—William A. Powell

*Attorney, Agent, or Firm*—Gary P. Topolosky

[57] ABSTRACT

A substantially nitrate-free solution for milling products of refractory metals, especially titanium, which solution comprises: (a) about 5–100 g/l of ammonium bifluoride; (b) up to about 90 g/l of hydrochloric acid; and (c) a balance of water and impurities. Preferred embodiments of this aqueous solution consist essentially of about 15–75 g/l of $NH_4HF_2$ and about 8–70 g/l of HCl. An alternative embodiment includes up to about 170 g/l of $H_2O_2$. There is further disclosed a method for chemically milling, etching and/or pickling metal products, such as titanium alloy forgings, with the aforementioned solutions.

26 Claims, No Drawings

MILLING SOLUTION AND METHOD

BACKGROUND OF THE INVENTION

1. Field of the Invention

This invention relates to an improved chemical milling solution and method for milling, etching or pickling metal products therewith More particularly, the invention relates to a bath composition and method for milling or pickling titanium workpieces, such as forgings or the like.

2. Technology Review

As used herein, the term "milling" shall mean the selective and controlled removal (or corrosion) of metal (or metal oxides) from a part or object by chemical milling, etching and/or pickling Most milling procedures form metal product of a desired thickness and/or configuration by removing metal from treated workpieces and imparting greater weight savings to aerospace parts or the like. Milling operations are typically performed after particular metal parts have been formed by casting, forging, extrusion or rolling; and heat treated. Milling is also used to make shapes which cannot otherwise be machined by conventional chip-making techniques, or which can only be machined by known methods at unreasonably high cost. For many parts, masking of certain areas is done to prevent their exposure to a corrosive milling solution.

As used for the description of this invention, "milling" shall also include metal etching, the controlled removal of metal for dimensional and shape control, and metal cleaning or pickling, i.e., the removal of embrittled oxidized surfaces For titanium alloys, embrittled surfaces are sometimes referred to as alpha-case. Such surfaces typically result from elevated temperature exposure in the manufacturing process, i.e., casting, rolling, extrusion, forging or the like.

Any chemically dissolvable metal may be subjected to treatment by the aforementioned milling practices. Alloys of aluminum, beryllium, magnesium, titanium and various steels are the most commonly milled metal products. Refractory metals such as molybdenum, tungsten, niobium (columbium) and zirconium may also be chemically etched in the same manner. The workpieces treated by milling (i.e. chemical, etching and/or pickling) need not be limited by size provided a large enough bath of milling solution can be maintained. Milled parts may be cast, forged, extruded or rolled. Their end shapes may be flat, tubular or in any of the complex configurations required by today's manufacturers of aerospace and other parts.

The first chemical milling practices are believed to have occurred around 2500 B.C., when ancient Egyptians used citric acid to etch copper jewelry. Current industrial milling U.S. Pat. No. 2,739,047. Numerous evolutions to milling patented over 35 years ago. Many of these solution developments depended on the particular metal alloy being milled.

For titanium and titanium-based alloys, Chen U.S. Pat. No. 4,900,398 claims a milling method which uses an aqueous solution consisting essentially of 1-5% hydrofluoric acid, about 1.5-4% chlorate ion and, optionally, up to about 20% of an acid selected from the group consisting of $H_2SO_4$, HCl and $HNO_3$.

Kremer et al. U.S. Pat. No. 4,314,876 discloses a milling solution consisting essentially of: 3-10 wt.% ammonium bifluoride; 5-15 wt.% nitric acid, or its equivalent as ammonium nitrate, sodium nitrate or potassium nitrate; 2-25 wt.% hydrochloric acid when ammonium nitrate, sodium nitrate or potassium nitrate is used as the nitrate source; up to 1 wt.% wetting agent; and 92-49 wt.% water. According to the examples, this solution removes Ti metal at rates ranging from 0.000027 to 0.00074 mils/side/minute.

In Coggins et al. U.S. Pat. No. 4,116,755, there is claimed a method and composition for milling titanium without excessive hydrogen absorption. The composition comprises, per liter of solution: about 126-700 grams of pure nitric acid, or its equivalent; the equivalent of about 8.8-176.1 grams of pure hydrofluoric acid; at least 10 grams of a carbonic acid derivative; and at least about 1.5 grams of a monocarboxylic acid derivative containing alkali metal ions.

Coggins et al. U.S. Pat. No. 3,944,496 claims a milling composition for titanium and other factory metals which comprises: about 210-630 grams of pure nitric acid; about 98-440 grams of pure phosphoric acid or its phosphate ion-producing equivalent; about 61-88 grams of pure hydrofluoric acid, or its fluoride-producing equivalent; and a carbonic acid derivative equivalent to about 15 grams or more of carbamide.

In Roni U.S Pat. No. 3,844,859, an improved method for milling titanium includes immersing metal in an aqueous fluid containing: a sufficient amount of hydrofluoric acid for effecting an etch rate of about 4-15 mils/side/minute; a sufficient amount of dodecylbenzene sulfonic acid and linear alkyl sulfonic acid for keeping the surface tension of this fluid between about 28-60 dynes/cm; and about 0.2-1.2 wt.% nitric acid. About 0.07-2.9 wt. % ammonium bifluoride may be added to this solution for reducing channeling and ridging in the fillet areas of a vertically-milled part.

Gumbelevicius U.S. Pat. No. 3,788,914 employs a titanium milling solution which contains, per liter of solution: about 126-682 grams of nitric acid; the equivalent of about 8.8-176.1 grams of pure hydrofluoric acid; and at least about 10 grams of a carbonic acid derivative selected from carbamide, urea nitrate, urea oxalate and semi-carbazide.

Kreml U.S. Pat. No. 3,666,580 discloses a milling solution comprising 2-10 vol. % hydrofluoric acid and 1-10 vol.% hydrochloric acid, with a remainder of water. This solution is maintained at a temperature between 65-140° F. for the milling of titanium metal parts therein.

The milling composition of Snyder et al. U.S. Pat. No. 2,981,610 contains: about 0.1-4.7 molar nitrate; about 0.1-2.2 molar chloride; about 0.25-5.3 molar fluoride; at least about 0.22 normal acetate; and a hydrogen ion concentration of about 2.8-10.7 molar.

Current practices for chemically milling, etching and pickling titanium workpieces employ baths of hydrofluoric acid and nitric acid in various concentrations. Hydrofluoric acid poses risks to the health of its day-to-day handlers, however. Any process that employs HF poses another major risk in the event of an accidental release into the environment. Because of these concerns, hydrofluoric acid is being considered for greater Federal regulation. Nitric acids, on the other hand, release visible fumes of toxic $NO_x$ during standard milling operations. Emission source locations are also under increasing regulatory pressure to reduce or eliminate such emissions from the workplace. Although hydrofluosilicic acid ($H_2SiF_6$) has been proposed as an HF substitute, this liquid is also hazardous and quite volatile.

BRIEF DESCRIPTION OF THE INVENTION

It is a principal objective of this invention to provide a milling solution and method which eliminates the use of hydrofluoric acid. It is another objective to provide a bath composition for chemically milling, etching and/or pickling metal workpieces, which composition eliminates the need for using $HNO_3$ or any derivatives thereof. This invention represents a significant environmental advance over existing art by using a substantially nitrate-free solution for milling titanium and other metal parts.

It is another objective to provide a milling method whose bath produces a commercially acceptable metal removal rate of about 0.25 mils/side/minute or higher. It is another objective to provide means for chemically milling titanium and other refractory metals at moderate operating temperatures. It is yet another objective to provide a pickling method whose bath removes embrittled or oxidized surfaces from titanium and other metals at a commercially acceptable rate.

It is another principal objective to provide a milling formula which reduces the amount of hydrogen gas absorbed onto the metal surface being milled, especially for those embodiments of the invention adding at least some $H_2O_2$ to the milling bath. This invention thus decreases the negative impact of hydrogen absorption on metal embrittlement and other metal properties. This invention achieves reduced hydrogen absorption without resorting to such hydrogen suppressor additives as nitric acid or chromic acid.

It is another objective of this invention to provide improved means for milling (i.e., chemically milling, etching and/or pickling) titanium alloys, especially alpha, alpha-beta and beta phase titanium alloys such as Ti-6Al-4V, Ti-6Al-6V-2Sn, Ti-10V-2Fe-3Al and others, which method overcomes the disadvantages of the prior art referred to hereinabove.

In accordance with the foregoing objects and advantages, this invention provides a substantially nitrate-free solution for milling metal products, especially titanium and titanium alloy workpieces The solution comprises: (a) about 5–100 g/l of ammonium bifluoride; (b) up to about 90 g/l of hydrochloric acid (or about 200 ml/1 of 36.5 wt. % HCl or its equivalent); and (c) a balance of water and impurities. Preferred embodiments of this aqueous solution consist essentially of about 15–75 g/l of $NH_4HF_2$ and about 8–70 g/l HCl (or 20–160 ml/1 of the 36.5 wt. % HCl). An alternative embodiment adds up to about 170 g/l of pure hydrogen peroxide (or about 500 ml/1 of 30 wt. % $H_2O_2$), to the solution for reducing the amount of hydrogen absorbed by titanium workpieces during the milling process. There is further disclosed a method for chemically milling, etching and/or pickling such metal products as Ti-6Al-4V, Ti-6Al-6V-2SN, Ti-10V-2Fe-3Al and other alloy forgings, with the aforementioned solutions.

DETAILED DESCRIPTION OF PREFERRED EMBODIMENTS

As used herein, the term "substantially nitrate-free" shall mean that the milling solution of this invention contains no nitrate ions, in any form, by way of positive addition to the other milling solution components. Since mixing conditions and component integrities are not always perfect, however, it is to be understood that trace amounts of nitrates or nitrate-forming compounds (i.e., less than about 1 wt. %) may find their way into the milling bath, even by way of contamination from the numerous metal surfaces being treated with this milling bath. Such inadvertent additions are intended to fall within the term "impurities" that accompanies the water basis for this aqueous milling stream.

With respect to the claimed concentration of hydrochloric acid and hydrogen peroxide added to various embodiments of this invention, commercial suppliers of hydrochloric acid make such products available in concentrations of 32 or 36.5 wt. % HCl by way of dilution. Hydrogen peroxide is likewise packaged in concentrations of about 30 to 70 wt. % $H_2O_2$ It is to be understood that the equivalents of such components should be calculated based on concentrations used according to the present invention.

Repeated references are made throughout this description to the milling of a titanium-based alloy referred to as Ti-6Al-4V. This alloy generally contains about 6 wt. % aluminum and about 4 wt. % vanadium with a remainder of titanium. It is characterized by good corrosion resistance, elevated temperature strength and stability as well as good machinability. The alloy is typically sold in bar, sheet, strip, wire, extruded shape and tubing forms. It also lends itself well to the production of a variety of forging shapes. The invention is not intended to be limited to this particular alpha-beta phase titanium alloy, however. Another representative alloy containing both alpha and beta phases comprises about 6% aluminum, 2% tin, 4% zirconium, 2% molybdenum and a remainder of titanium (Ti-6Al-2Sn-4Zr-2Mo). When hardened by aging treatment, this alloy exhibits even tensile strengths comparable to that of Ti-6Al-4V. It is best suited for applications wherein heavy stresses are imparted for long periods of time at high temperatures. The alloy possesses good strength, toughness and stability properties at temperatures up to about 482° C. (900° F). Another alloy possessing particularly good welding characteristics and fabricability, with somewhat improved tensile strength, is a titanium-based alloy containing about 6% aluminum, 6% vanadium and 2% tin (Ti-6Al-6V-2Sn).

The milling method and composition of this invention may also be used with other titanium-based alloys, such as commercially pure titanium metal (i.e., at least about 99.3 wt. % pure) and those alloys containing only alpha phases, only beta phases such as Ti-10V-2Fe-3Al, and those containing an alpha-2 phase or gamma phase. Titanium alloys with a beta phase, alone or in combination with an alpha phase, are generally more difficult to chemically mill due to the high affinity of beta and alpha-beta alloys for hydrogen. Titanium-based alloys are particularly useful for aerospace applications, including airframe and engine parts, due to their light weight, high strength and thermal stability. Such parts are frequently machined by milling to thin cross sections and very smooth outer surface finishes.

Hydrogen absorption onto the surfaces of the metal being milled may impart an internal stress on the metal workpiece. Such stresses may cause these metal parts to crack prematurely. With some metals, including titanium, $H_2$ absorption in sufficient quantities may cause undesirable metal hydrides to form. In the industry, excessive hydrogen absorption is more commonly referred to as "hydrogen embrittlement". It is a principal objective of this invention to minimize the amount of hydrogen absorbed into a surface treated with the above-described milling solution In titanium metal alloys, the degree of hydrogen absorbed is generally proportional to the amount of beta-phase present and surface area to volume ratio of the workpiece being milled. Hydrogen contents of a milled article are typically measured in parts per million. Most aeronautical specifications for titanium alloys permit a maximum hydrogen absorption concentration of about 150–200 parts per million, depending upon the particular alloy involved. Such applications are generally more conservative with respect to amounts of $H_2$ absorbed, however. For some non-aerospace uses of titanium workpieces, higher $H_2$ concentrations of up to about 500 parts per million may be tolerated.

The ammonium bifluoride-hydrogen chloride milling solution of this invention has been found to produce acceptably low levels of hydrogen pickup in many alloys, such as Ti-6Al-4V, while avoiding the need to add such typical hydrogen suppressants as nitric acid or chromic acid ($CrO_3$). For some titanium alloys, it may be beneficial to add up to about 170 g/l of hydrogen peroxide to the bath. This was the case with Ti-10V-2Fe-3Al where minor additions of $H_2O_2$ reduced hydrogen pickup by as much as 60%. It is believed that $H_2O_2$, like nitric or chromic acid, provides an oxide layer on the metal surface being milled. This layer then tempers the action of HCl thereon while providing some barrier for hydrogen diffusion into the metal surface being milled. Unlike $HNO_3$, however, hydrogen peroxide does not emit toxic fumes. Nor does it contain such toxic ions as hexavalent chromium.

The bath composition and method of this invention may also be used to chemically mill, etch and/or pickle metals other than titanium-based alloys. Other transition metals such as zirconium and refractory metals such as niobium (columbium), molybdenum, tungsten and/or tantalum may be milled with this same aqueous solution.

In the typical chemical milling of a titanium alloy product, it is preferred that such product first be cleaned with trichloroethylene, or another known cleaner, before exposure to the milling bath of this invention. Such cleaning serves to remove any surface contaminants, such as grease, oil, etc., which may remain from metal part fabrication or other pre-treatment steps. Cleaning also reduces contamination of the milling bath while providing a clean surface for better adhesion of any masks applied to the product surface.

Depending upon the final product size and shape, it may be necessary to mask portions of the workpiece being milled by any known or subsequently developed means. One representative masking means is referred to as photoresistive masking. Another method subjects the areas to be masked to dipping in a neoprene-based maskant such as the version commonly supplied by Turco Company Products, Inc. This mask may be maintained at room temperature and has a viscosity of about 40 seconds as measured with a Zahn No. 5 viscometer. A neoprene-based maskant coating is then allowed to dry on the product at room temperature until it is essentially tack-free. This may take up to about 40 minutes depending upon the areas to be coated and number of maskant coatings applied thereto.

A milling template may then be used to cut away (or scribe) a particular pattern into the masked areas of some workpieces. After all such lines and patterns are scribed, the specimen is ready for immersion into the solution of this invention. In some instances, product specimens are repeatedly dipped into one or more vats of milling solution. In other cases, the solution into which titanium alloy products are dipped may be agitated by means of an electric stirrer or a continuous circulation pump. Such means serve to flow solution continuously over the metal part being milled so that a layer of relatively fresh bath contacts with the surface being milled. This helps the invention achieve a substantially uniform rate of milling or etching, usually on the order of about 0.5–1.5 mils/side/minute.

In the pickling of titanium alloy products to remove an embrittled surface (or alpha case layer) thereon, it is preferred that such products be cleaned before being exposed to the milling solution of this invention. Such cleaning may be performed chemically, by exposing the product to salt bath or the like, or by using any mechanical scale removal technique well known to those skilled in this art. This pre-milling cleaning removes any scale, lubricants and other surface contaminants which might otherwise impede or hinder pickling according to the invention.

Preferred embodiments of this invention maintain the milling bath at a slightly elevated temperature, usually between about 21–71° C. (70–160° F.), and more preferably between about 32–57° C. (90–135° F.). It is believed that such temperatures enhance metal removal rates while not imposing undue bath handling hardships.

The following examples are provided by way of illustration. They are not intended to limit the scope of this invention in any manner, however. About 2500 ml of milling solution was prepared for each of these examples. In the solution of Example 1, a 5.913 g specimen of Ti-6Al-4V having an average thickness of 0.104 inch was immersed, unmasked and with both sides exposed, while the solution was continuously stirred. About 2 g/l of titanium sponge was also inserted into each bath (except for those baths in Table 4) to condition the bath and provide a consistent starting titanium concentration therein. After 20 minutes in the bath, this specimen was removed, rinsed with a nitric acid solution, dried, weighed and measured. This procedure was repeated several times with similarly sized specimens for the respective variables and constants described for Tables 1 through 4. For the Table 5 data, samples of Ti-10V-2Fe-3Al were milled with a solution to which $H_2O_2$ was purposefully added.

EXAMPLES 1–6

For the following data, the amount of NH4HF2 added to each solution was kept constant, at 85.5 g (0.6 M) and the bath temperature kept at 65° C. (150° F.) while various amounts of HCl were added for determining the effect of HCl concentration on milling rate and post-milling hydrogen content. The milling rates for all data herein were calculated using the differences in average specimen thickness and total exposure time.

TABLE 1

| Ex. | 36.5 wt. % HCl ml (M) | Milling Rate mils/min/side | Hydrogen Content After Milling ppm |
|---|---|---|---|
| 1 | 0 (0) | 0.268 | 42 |
| 2 | 62 (0.3) | 0.548 | 35 |
| 3 | 124 (0.6) | 0.750 | 39 |
| 4 | 195 (0.94) | 1.001 | 30 |
| 5 | 248 (1.2) | 1.275 | 20 |
| 6 | 372 (1.8) | 1.250 | 36 |

EXAMPLES 7-10

For the following data, hydrochloric acid concentrations of the present solution were kept constant at 248 ml (or 1.2 M) of 36.5 wt. % HCl, together with a constant solution temperature of 65° C. (150° F.) for determining the effect of various $NH_4HF_2$ concentrations on milling rate and hydrogen absorption.

TABLE 2

| Ex. | $NH_4HF_2$ g (M) | Milling Rate mils/min/side | Hydrogen Content After Milling ppm |
|---|---|---|---|
| 7 | 42.8 (0.3) | 0.475 | 43 |
| 8 | 85.5 (0.6) | 1.275 | 20 |
| 9 | 128.3 (0.9) | 1.450 | 31 |
| 10 | 171.0 (1.2) | 1.425 | 42 |

EXAMPLES 11-16

In the next six examples, various milling temperatures with a constant composition comprising 85.5 grams of $NH_4HF_2$ and 248 ml of 36.5 wt. % HCl per 2500 ml of total solution.

TABLE 3

| Ex. | Temperature °F. | Milling Rate mils/min/side | Hydrogen Content After Milling ppm |
|---|---|---|---|
| 11 | 150 | 1.275 | 20 |
| 12 | 140 | 0.950 | 30 |
| 13 | 130 | 0.725 | 10 |
| 14 | 120 | 0.600 | 18 |
| 15 | 110 | 0.450 | 24 |
| 16 | 100 | 0.300 | 28 |

EXAMPLES 17-21

For the following data, milling temperature was kept constant at 150° F. while the size of the Ti sponge added thereto was varied. The respective concentrations of $NH_4HF_4$ and HCl were also varied in an amount sufficient to compensate for the excess Ti sponge above 2 g/l. Such compensation resulted in experimental solutions containing a constant amount of unreacted $NH_4HF_2$ and HCl with varying concentrations of reaction by-products.

TABLE 4

| Ex. | (36.5 wt. %) $NH_4HF_2$/HCl g/ml | Ti Sponge g | Milling Rate mils/min/side | Hydrogen Content After Milling ppm |
|---|---|---|---|---|
| 17 | 85.5/248 | 5 | 1.275 | 20 |
| 18 | 112.3/287 | 20 | 1.100 | 38 |
| 19 | 148.9/339 | 40 | 0.950 | 28 |
| 20 | 183.7/390 | 60 | 0.975 | 31 |
| 21 | 219.4/442 | 80 | 1.025 | 26 |

EXAMPLES 22-25

For the following data, a total solution volume of 2500 ml was prepared, said solution containing constant concentrations of 120 g $NH_4HF_2$ (or 0.84 M0 and 350 ml of 36 wt. % HCl (or 1.69 M). The amount of $H_2O_2$ added to these solutions was then varied to determine the effect of peroxide additions on milling rate at hydrogen absorption by specimens of a Ti-10V-2Fe-3Al alloy. for all of these runs, the specimen was submerged for 20 minutes in a solution maintained at 54° C. (130° F.).

TABLE 5

| Ex. | 30 wt. %. $H_2O_2$ ml (M) | Milling Rate mils/min/side | Hydrogen Content After Milling ppm |
|---|---|---|---|
| 22 | 0 (0.00) | 0.9 | 217 |
| 23 | 108 (0.42) | 0.95 | 195 |
| 24 | 215 (0.84) | 1.325 | 150 |
| 25 | 430 (1.69) | 0.5 | 86 |

EXAMPLE 26

For further comparison, 3000 grams of a solution was prepared containing 240 grams (or 8 wt. %) of $NH_4HF_2$, 360 grams (12 wt. %) of 36.5% HCL, and 255 grams of $NaNO_3$ (or 8.5 wt. %). A Ti-6Al-4V specimen was then placed in this solution and milled on both sides at 33-42° C. (92-108° F.) for 60 minutes. The weight of this specimen decreased from 15.440 to 15.406 grams while its thickness decreased from 0.204 to 0.201 inch. The milling rate for this solution to which nitrate was purposefully added calculated at 0.025 mils/minute/side.

Having described the presently preferred embodiments, it is to be understood that the invention may be otherwise embodied within the scope of the appended claims.

What is claimed is:

1. A substantially nitrate-free solution for milling a metal product which comprises: (a) about 5-100 g/l of ammonium bifluoride; (b) up to about 90 g/l of hydrochloric acid; and (c) a balance of water and impurities.

2. The milling solution of claim 1 which comprises about 15-75 g/l of ammonium bifluoride, about 8-70 g/l of hydrochloric acid and water.

3. The milling solution of claim 1 which further contains up to about 170 g/l of hydrogen peroxide.

4. The milling solution of claim 3 which contains about 25-85 g/l of hydrogen peroxide.

5. The milling solution of claim 1 wherein the nitrate concentration is about 1 wt. % or less.

6. The milling solution of claim 1 wherein the metal product consists essentially of a titanium alloy having alpha and beta phases.

7. The milling solution of claim 6 wherein the titanium alloy is selected from the group consisting of: Ti-6Al-4V, Ti-6Al-6V-2Sn, Ti-10V-2Fe-3Al and commercially pure Ti metal.

8. An aqueous solution suitable for milling a titanium product at one or more temperatures between about 21-71° C. (70-160° F.), said solution consisting essentially of: about 15-75 g/l of ammonium bifluoride; and about 8-70 g/l of hydrochloric acid.

9. The solution of claim 8 wherein milling occurs at about 32-57° C. (90-135° F.).

10. The solution of claim 8 wherein the titanium product is a Ti-6Al-4V forging.

11. The solution of claim 8 wherein titanium is removed from the product surface at a rate of about 0.25 mils/side/minute or higher.

12. The solution of claim 11 wherein titanium is removed at a rate of about 0.5-1.5 mils/side/minute.

13. The solution of claim 8 which produces a post-milling hydrogen content of about 150 ppm or less.

14. A method for chemically milling a metal workpiece comprising:

(a) providing an aqueous solution consisting essentially of about 15–75 g/l of ammonium bifluoride and about 8–70 g/l of hydrochloric acid;

(b) maintaining the solution at one or more temperatures between about 21–71° C. (70–160° F.); and (c) immersing the workpiece in the solution to mill the surfaces of the workpiece in contact with the solution.

15. The method of claim 14 which further comprises one or more of the following steps before immersing the workpiece in the solution:

(i) cleaning the workpiece; and (ii) masking areas of the workpiece.

16. The method of claim 14 which further comprises one or more of the following steps after immersing the workpiece in the solution:

(i) stirring or agitating the solution with the workpiece therein; and (ii) rinsing the workpiece after it is removed from the solution.

17. The method of claim 14 wherein the solution further includes about 25–100 g/l of hydrogen peroxide.

18. The method of claim 14 wherein step (b) includes maintaining the solution at about 32–57° C. (90–135° F.).

19. The method of claim 14 wherein the workpiece is made from a titanium alloy.

20. The method of claim 19 wherein the workpiece is a titanium alloy forging wherein said alloy is selected from the group consisting of: Ti-6Al-4V, Ti-6Al-6V-2Sn, Ti-10V-2Fe-3Al and commercially pure titanium metal.

21. A method for treating a metal product to remove an embrittled surface layer therefrom, said method comprising:

(a) providing a heated solution comprising about 5–100 g/l of ammonium bifluoride; about 8–70 g/l of hydrochloric acid; and a balance of water and impurities; and (b) contacting the surface layer of the metal product with the heated solution.

22. The method of claim 21 which further comprises chemically removing scale from the surface layer of the metal product before contacting it with the heated solution.

23. The method of claim 21 which further comprises mechanically removing scale from the surface layer of the metal product before contacting it with the heated solution.

24. The method of claim 21 wherein the heated solution further comprises about 25–100 g/l of hydrogen peroxide.

25. The method of claim 21 wherein the solution is heated to one or more temperatures between about 32–71° C. (90–160° F.).

26. The method of claim 21 wherein the metal product is made from a titanium alloy selected from the group consisting of: Ti-6Al-4V, Ti-6Al-6V-2Sn, Ti-10V-2Fe-3Al and commercially pure titanium metal.

* * * * *

UNITED STATES PATENT AND TRADEMARK OFFICE

CERTIFICATE OF CORRECTION

PATENT NO. : 5,100,500

DATED : March 31, 1992

INVENTOR(S) : Leroy E. Dastolfo et al

It is certified that error appears in the above-identified patent and that said Letters Patent is hereby corrected as shown below:

| | |
|---|---|
| Col. 1, line 57 | After "milling" insert --practices can be traced back to the methods set forth in Sanz--. |
| Col. 1, line 58 | AFter "milling" insert --solutions have occurred since modern milling procedures were--. |
| Col. 2, line 19 | Change "factory" to --refractory--. |
| Col. 6, line 50 | Change "NH4HF2" to --$NH_4HF_2$--. |
| Col. 7, line 22 | After "temperatures" insert --were employed--. |
| Col. 7, line 62 | Change "(or 0.84 MO)" to --(or 0.84 M)--. |
| Col. 8, line 15 | Change "36.5% HCL" to --36.5% HCl--. |

Signed and Sealed this

Twenty-first Day of September, 1993

Bruce Lehman

*Attest:*

BRUCE LEHMAN

*Attesting Officer*

*Commissioner of Patents and Trademarks*